US006020731A

United States Patent [19]

Shinohara

[11] Patent Number: 6,020,731

[45] Date of Patent: Feb. 1, 2000

[54] CONSTANT VOLTAGE OUTPUT CIRCUIT WHICH DETERMINES A COMMON BASE ELECTRIC POTENTIAL FOR FIRST AND SECOND BIPOLAR TRANSISTORS WHOSE BASES ARE CONNECTED

[75] Inventor: Mahito Shinohara, Machida, Japan

[73] Assignee: Canon Kabushiki Kaisha, Tokyo, Japan

[21] Appl. No.: 09/022,411

[22] Filed: Feb. 12, 1998

[30] Foreign Application Priority Data

Feb. 14, 1997 [JP] Japan ..... 9-030082

[51] Int. Cl.[7] ..... G05F 3/16

[52] U.S. Cl. ..... 323/316; 323/313

[58] Field of Search ..... 323/313, 314, 323/316; 330/297, 277

[56] References Cited

U.S. PATENT DOCUMENTS

| | | | |
|---|---|---|---|
| 4,714,872 | 12/1987 | Traa | 323/314 |
| 5,119,015 | 6/1992 | Watanabe | 323/313 |
| 5,291,122 | 3/1994 | Audy | 323/313 |
| 5,319,303 | 6/1994 | Yamada | 323/313 |
| 5,654,673 | 8/1997 | Shinohara | 330/297 |
| 5,712,557 | 1/1998 | Gehrt et al. | 323/316 |
| 5,714,872 | 2/1998 | Heimerl et al. | 323/273 |

*Primary Examiner*—Adolf Deneke Berhane

*Attorney, Agent, or Firm*—Fitzpatrick Cella Harper & Scinto

[57] ABSTRACT

A constant voltage output circuit is constructed by first and second bipolar transistors whose bases are connected, a first resistor connects the emitter of the first bipolar transistor to a constant voltage source (ground), second and third resistors which are serially connected connect the emitter of the second bipolar transistor to the constant voltage source, and a common base electric potential of the first and second bipolar transistors is determined so that an electric potential of the emitter of the first bipolar transistor and an electric potential of a connecting portion of the second and third resistors are equalized. With this construction, a circuit is provided having a stable constant output voltage, and the selection width of the constant output voltage is wide.

13 Claims, 3 Drawing Sheets

CONSTANT VOLTAGE OUTPUT CIRCUIT WHICH DETERMINES A COMMON BASE ELECTRIC POTENTIAL FOR FIRST AND SECOND BIPOLAR TRANSISTORS WHOSE BASES ARE CONNECTED

BACKGROUND OF THE INVENTION

1. Field of the Invention

The invention relates to a constant voltage output circuit and, more particularly, to a constant voltage output circuit which can reduce a restriction in a manufacturing process and can obtain a wide voltage set range.

2. Related Background Art

Hitherto, particularly, in an electronic circuit which handles an analog signal, there is a case where in addition to a ground level (ground) and a power voltage, a constant intermediate voltage source which is not susceptible to a variation in power of a power source and temperature is needed.

FIG. 1 is a diagram showing an example of a conventional constant voltage output circuit. In the diagram, reference numeral 1 denotes a bipolar transistor (hereinafter, abbreviated to BJT); 2 indicates a BJT whose size is larger than the BJT 1. The size of BJT 2 is generally just an integer value times as large as the size of BJT 1. Reference numerals 3 and 4 denote resistors having a same resistance value $R_0$. Terminals 5 and 6 of the resistors 3 and 4 are connected to collector terminals of the BJT 1 and BJT 2, respectively. The other terminals of the resistors 3 and 4 are mutually connected and become a common terminal 7. Reference numeral 8 denotes a resistor of a resistance value $R_1$ connecting an emitter of the BJT 2 and ground and 9 indicates an operational amplifier (hereinafter, referred to as an op-amplifier) in which a (+) input terminal (non-inverting input terminal) is connected to the terminal 5, a (−) input terminal (inverting input terminal) is connected to the terminal 6, and an output is connected to the common terminal 7. An emitter of the BJT 1 is directly connected to ground. Bases of the BJTs 1 and 2 are mutually connected to the terminal 5.

FIG. 2 shows a constructional example of the BJT 2. Collectors of four BJTs 1' of the same size as that of the BJT 1 are mutually connected, their bases are mutually connected, and their emitters are mutually connected, thereby setting the size of BJT 2 to be just four times as large as that of BJT 1.

In the circuit of FIG. 1, a point will now be described that by setting resistance values $R_0$ and $R_1$ in accordance with characteristics of the BJTs 1 and 2, a predetermined voltage can be generated from the terminal 7. It is now assumed that the size of BJT 2 is four times as large as that of BJT 1 and current gain of the BJT 2 is large and a emitter current and a collector current are equal.

In FIG. 1, current flowing through the resistor 3, namely, a collector current of the BJT 1 is labeled as $\mathbf{1}_0$. Since electric potentials of the terminals 5 and 6 are equal due to the operation of the operational amplifier 9, a current flowing in the resistor 4, namely, the collector current of the BJT 2 is also equal to $I_0$. Now, assuming that the output voltage of the terminal 7 is called $V_{BG}$ and base-emitter voltages of the BJTs 1 and 2 are set to $V_{BE1}$ and $V_{BE2}$, $$V_{BG}=V_{BE1}+I_0R_0 \quad (1)$$

$$V_{BE1}=V_{BE2}+I_0R_1 \quad (2)$$

are satisfied. Since the size of BJT 2 is four times as large as that of the BJT 1, $$V_{BE1}-V_{BE2}=(kT/q)\cdot In_4 \quad (3)$$

is satisfied.

Where, k: Boltzmann's constant

T: absolute temperature q: unit charges

By deleting $V_{BE2}$ and $I_0$ from the equations (1), (2), and (3), we have $$V_{BG}=V_{BE1}+(R_0/R_1)\cdot(kT/q)\cdot In_4 \quad (4)$$

By differentiating both sides of the equation (4) by T, $$dVB_{BG}/dT=dV_{BE1}/dT+(R_0/R_2)*(k/q)\cdot In_4 \quad (5)$$

is satisfied.

By deciding $R_0/R_1$ so as to obtain $$dV_{BE1}/dT+(R_0/R_1)\cdot(k/q)\cdot In_4=0$$

in accordance with the temperature characteristics of the BJT, the temperature dependency of $V_{BG}$ is eliminated from the equation (5). In the ordinary silicon BJT, since $dV_{BE1}/dT$ is equal to about −2mV/K, $R_0/R_1$ is equal to about 16. Generally, since the values of $R_0$ and $R_1$ are determined so that $V_{BE1}$ is equal to about 0.6V, the value of $V_{BG}$ is equal to about 1.2V as will be understood from the equation (4).

As described above, by setting the values of $R_0$ and $R_1$ in accordance with the BJT characteristics, a predetermined output voltage is derived from the terminal 7. By using such voltage as a reference for the electronic circuit, a voltage level can be accurately set.

In the above example, however, a BJT in which an emitter, a base, and a collector can be taken out as independent terminals is necessary. Although the constant voltage output circuit is often used in a semiconductor IC, the above example can only be applied in a manufacturing process such that the BJT as mentioned above can be formed. There is a problem such that the above example cannot be applied to an IC using a manufacturing process which cannot form an independent BJT.

An output of the op-amplifier which is used in the above example is also a collector current source of the BJT and it is necessary to use an op-amplifier having a high current supplying ability. There is inevitably a problem such that the size of the op-amplifier has to be enlarged.

Further, as will be understood from the equation (4) of the constant voltage output, $V_{BG}$ can be changed by selecting the set potentials of $V_{BE1}$. However, generally, since a range where normal current-voltage characteristics of the bipolar transistor can be held is a range of about 0.5 to 0.7V as $V_{BE1}$, the constant voltage output in only a range of about 1.1 to 1.3V can be also set. In other words, there is a problem such that a selection width of the constant voltage output value is narrow.

SUMMARY OF THE INVENTION

It is an object of the invention to provide a constant voltage output circuit which can solve the problems as mentioned above.

That is, it is another object of the invention to provide a constant voltage output circuit in which a restriction for a manufacturing process is small.

Still another object of the invention is to provide a constant voltage output circuit which can be easily miniaturized in a small area.

Further another object of the invention is to provide a constant voltage output circuit which can obtain a wide range of a constant voltage output that can be set.

Further another object of the invention is to provide a constant voltage output circuit which can produce a high performance constant voltage output by a simple construction and can also be applied to a CMOS process.

Further another object of the invention is to provide a constant voltage output circuit comprising: first and second bipolar transistors whose bases are mutually connected; a first resistor for connecting an emitter of the first bipolar transistor to a constant voltage source; second and third resistors which are serially connected and connect an emitter of the second bipolar transistor to the constant voltage source; and means for determining a common base electric potential of the first and second bipolar transistors so that an electric potential of the emitter of the first bipolar transistor and an electric potential of a connecting portion of the second and third resistors are equalized.

Further another object of the invention is to provide a constant voltage output circuit having first and second bipolar transistors each having a base, an emitter, and a collector, wherein the bases of the first and second bipolar transistors are electrically mutually connected, the emitter of the first bipolar transistor is connected to a line which is set to a predetermined electric potential through a first resistor, the emitter of the second bipolar transistor is connected to the line that is set to the predetermined potential through second and third resistors which are serially connected, an operational amplifier is arranged so that an electric potential between the emitter of the first bipolar transistor and the first resistor and an electric potential between the second and third resistors regarding the second bipolar transistors are inputted, and an output terminal of the operational amplifier and the bases of the first and second bipolar transistors are connected.

According to the invention, there is provided a constant voltage output circuit comprising: first and second BJTs whose bases are mutually connected; a first resistor for connecting an emitter of the first BJT to a constant voltage source (for example, a ground or a ground potential or the like); and second and third resistors which are serially connected and connect an emitter of the second BJT to the constant voltage source, wherein a common base electric potential of the first and second BJTs is determined so that an electric potential of the emitter of the first BJT and an electric potential of a node between the second and third resistors are equalized.

In the above construction, since collectors of the BJTs are connected to a common electric potential, a manufacturing process which is used in the invention can be simplified with respect to the conventional manufacturing process. Since it is sufficient to merely control the base potential in the constant voltage output, a scale of an operational amplifier (op-amplifier) or the like can be reduced in the invention. Further, by controlling the base potential by a resistance division of an output of the operational amplifier or the like, a degree of freedom of selection of a set value of the constant voltage output can be remarkably widened.

Further, by using a parasitic bipolar transistor, an ordinary bipolar transistor process becomes unnecessary.

DETAILED DESCRIPTION OF THE PREFERRED EMBODIMENTS

The invention will now be described hereinbelow with reference to the drawings.

(First embodiment)

Figure 1:
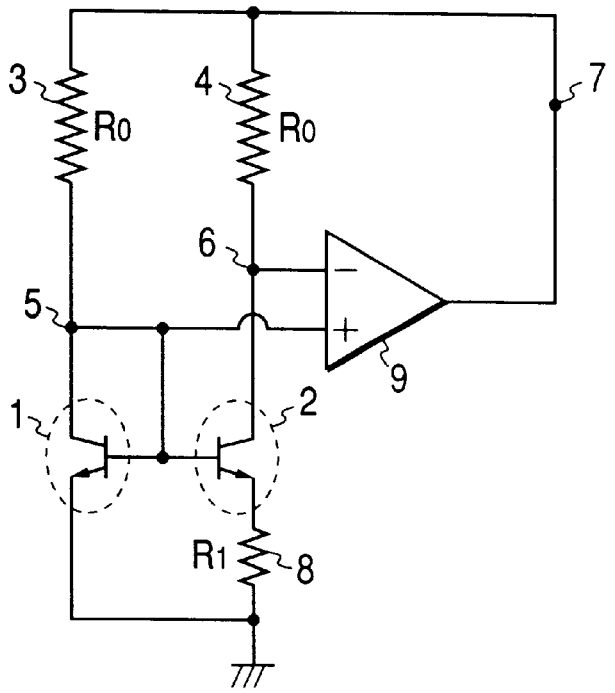
FIG. 1 PRIOR ART
FIG. 1 is a schematic circuit diagram for explaining an example of a constant voltage output circuit using bipolar transistors.
Figure 2:
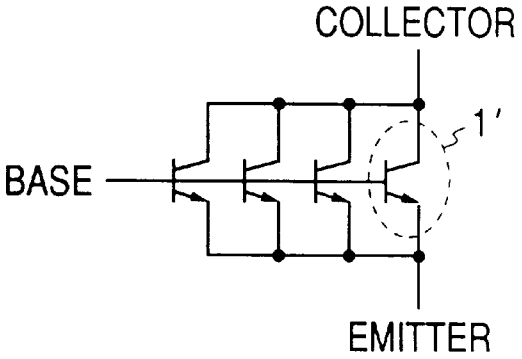
FIG. 2 is a conceptual diagram for explaining an example of forming a bipolar transistor of a large size.
Figure 3:
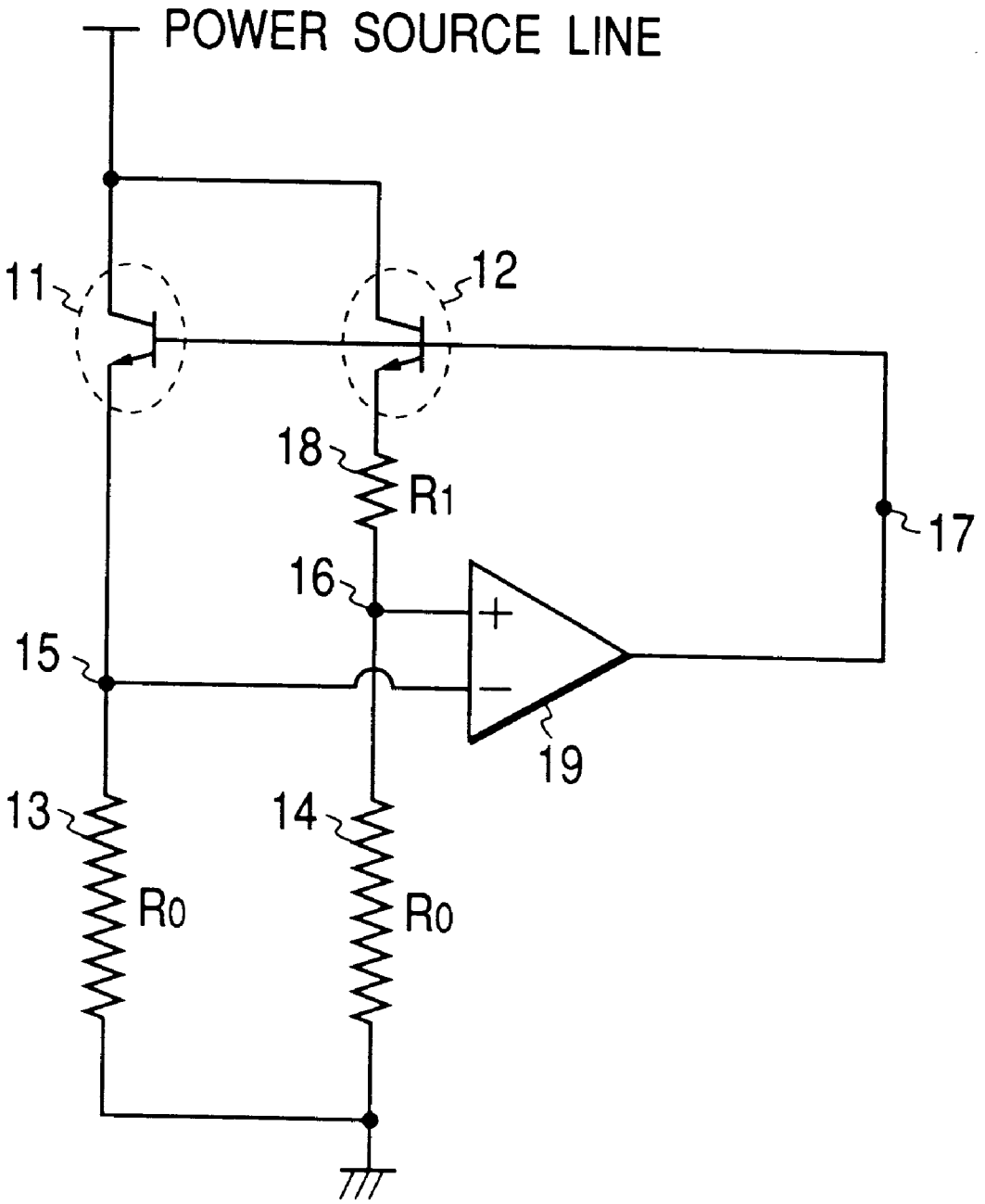
FIGS. 3 and 4 are schematic circuit diagrams for explaining preferred examples of a constant voltage output circuit of the invention, respectively.

FIG. 3 is a diagram for explaining a preferred example of a circuit of the invention. In the diagram, reference numeral 11 denotes a BJT and 12 indicates a BJT whose size is larger than that of the BJT 11. Generally, the size of BJT 12 is set to be just integer times as large as the size of BJT 11. Reference numeral 13 denotes a resistor having a resistance value $R_0$. An emitter 15 of the BJT 11 is connected to one terminal of the resistor 13 and the other terminal of the resistor 13 is connected to the ground. Reference numeral 14 denotes a resistor having the same resistance value $R_0$ as that of the resistor 13. One input terminal of the resistor 14 is connected to the ground and another terminal 16 is connected to one terminal of a resistor 18 having another resistance value $R_1$. The other terminal of the resistor 18 is connected to an emitter of the BJT 12. Reference numeral 19 denotes an operational amplifier in which a (+) input terminal is connected to the terminal 16 and a (−) input terminal is connected to the terminal 15 and an output terminal 17 is commonly connected to bases of the BJTs 11 and 12.

In FIG. 3, current gains of the BJTs 11 and 12 are sufficiently larger than 1 in a manner similar to the general BJT. Therefore, BJTs having characteristics such that a ratio between a collector current and an emitter current is almost equal to 1 are used. In this instance, the resistance values $R_1$ and $R_0$ are determined in a manner similar to the values of $R_1$ and $R_0$ decided in the foregoing example. Thus, a constant voltage output is generated which does not depend on a power source voltage and a temperature at the terminal 17 and its value is determined by the sum of a voltage drop amount of the resistor $R_0$ and a difference between the base-emitter potentials of the BJTs, so that the constant voltage output is equal to the same value of about 1.2V as that in the foregoing example.

In the BJTs which are used in the circuit of the invention, the construction such that the collector terminals are independent as in the foregoing circuit is unnecessary. Therefore, for example, it is also possible to use a BJT fixed to a semiconductor substrate. In other words, the semiconductor substrate can be also used as a collector region. Further, even if the formation of the BJT is not a purpose, the invention can be accomplished. For example, even in the CMOS process, the circuit of the invention can be constructed by using a parasitic bipolar transistor in which a P well is used as a base and an n-type source drain is used as an emitter and an n-type common substrate is used as a collector. According to the invention as mentioned above, the constant voltage output can be realized by a simpler manufacturing process or by taking into consideration a design layout of a semiconductor device even if any special process is not particularly executed.

As shown in FIG. 3, it is a base current of the BJT that is driven by the output of the op-amplifier serving as a constant voltage output. This means that although it is necessary to supply the collector current for the constant voltage output of the foregoing example, a current supply amount of the constant voltage output in the invention is extremely small.

Therefore, a scale of the op-amplifier which is used in the constant voltage output circuit can be sufficiently reduced.

(Second embodiment)

Figure 4:
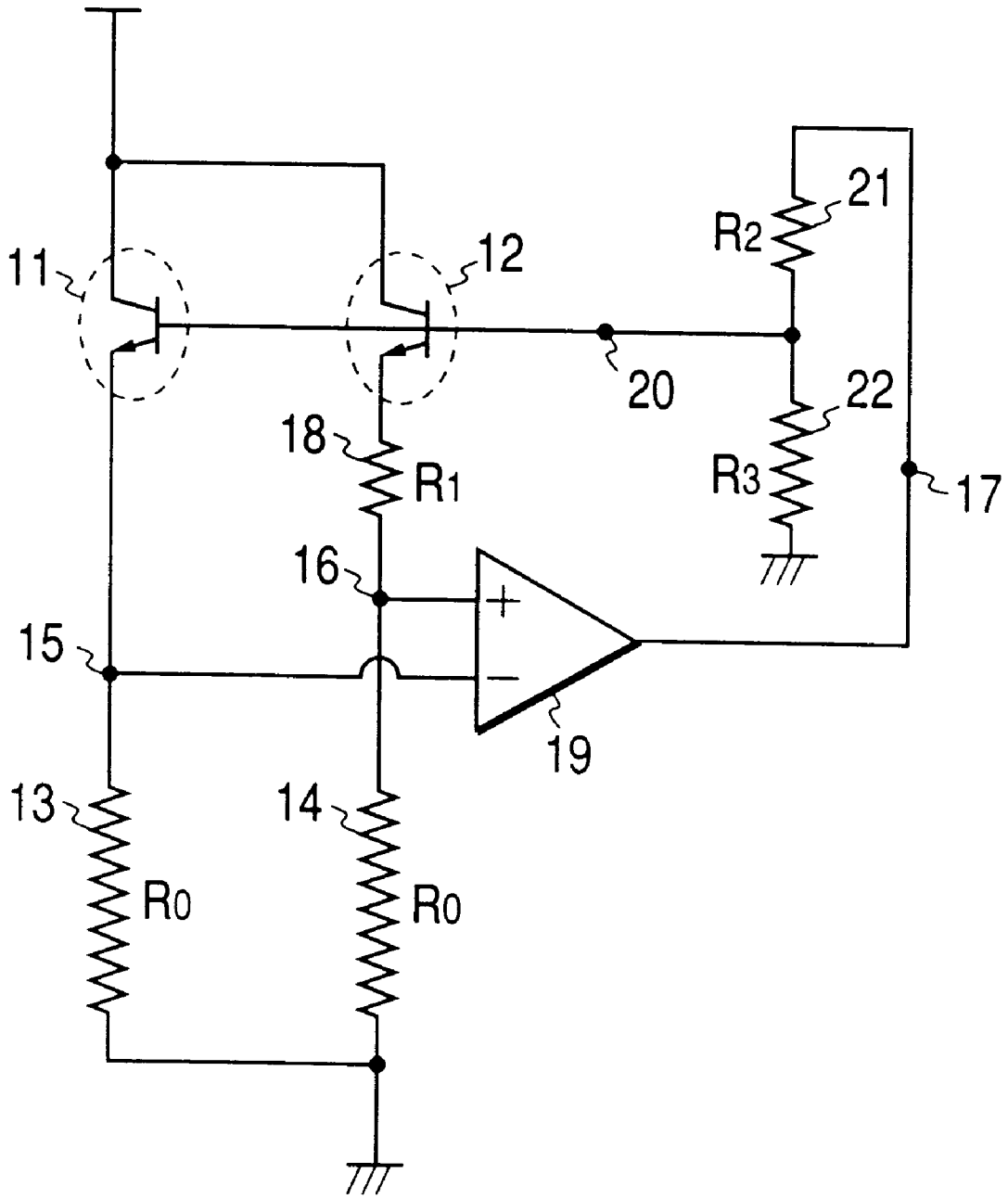

FIG. 4 is a diagram showing the second embodiment of the invention. In the diagram, reference numeral 20 denotes a common terminal of the bases of the BJTs 11 and 12; 21 a resistor having a resistance value $R_2$ for connecting the terminals 17 and 20; and 22 a resistor having a resistance value $R_3$ for connecting the terminal 17 and the ground level. In the diagram, the same component elements as those in FIG. 3 are designated by the same reference numerals and their descriptions are omitted.

In FIG. 4, a current flowing in the terminal 20 is much smaller than the current flowing in the resistors 21 and 22, 30 that it can be sufficiently ignored. A voltage of the terminal 20 has a voltage value obtained by dividing the voltage of the terminal 17 by the resistances $R_2$ and $R_3$. The voltage of the terminal 20 is a constant voltage of about 1.2V shown in the first embodiment of the invention, so that a voltage value of $(R_2+R_3)/R_3$ times as high as the voltage at the terminal 20 appears at the terminal 17. By properly selecting $R_2$ and $R_3$, a value of 1.2V or higher can be freely set as a constant voltage output value. According to the invention as mentioned above, since the constant voltage is determined by the base potential of the BJT, by multiplying such a value by a gain of a resistance ratio, freedom of selecting of the constant voltage output value can be made greater.

In the embodiment described above, although the case using NPN transistors as BJTs (bipolar transistors) has been shown, the invention can be also applied to a constant voltage output circuit constructed by using PNP transistors.

As described above, according to the invention, the restriction with respect to the manufacturing process to which the constant voltage output circuit can be applied can be remarkably reduced (on the contrary, the process is not made complicated). Particularly, even in the CMOS process, the constant voltage output circuit of the invention can be applied. Since a restriction with regard to the current supplying ability of the op-amplifier which is used in the constant voltage output circuit is also remarkably reduced, the scale of the op-amplifier or the like can be reduced. Further, although a range which can be set as a constant voltage value is about 1.1 to 1.3V hitherto, according to the invention, the constant voltage setting range can be extremely widened. It will be obviously understood that the constant voltage output can be stably performed.

The present invention is not limited to the foregoing embodiments but many modifications and variations are possible within the spirit and scope of the appended claims of the invention.

What is claimed is:

1. A constant voltage output circuit comprising:

first and second bipolar transistors whose bases are mutually connected;

a first resistor which forms a first connection path for connecting an emitter of said first bipolar transistor to a constant voltage source;

second and third resistors which are serially connected to form a second connection path, independent from the first connection path, for connecting an emitter of said second bipolar transistor to said constant voltage source; and determining means for determining a common base electric potential for said first and second bipolar transistors so that an electric potential of the emitter of said first bipolar transistor and an electric potential of a connecting portion of said second and third resistors are equalized.

2. A circuit according to claim 1, wherein said means is an operational amplifier.

3. A circuit according to claim 1, wherein said common base potential of said first and second bipolar transistors is set by resistance dividing an output of said means.

4. A circuit according to claim 1, wherein said constant voltage source includes a ground.

5. A circuit according to claim 1, wherein one of terminals of said first resistor is connected to the emitter side of said first bipolar transistor, an other of the terminals of said first resistor being connected to said constant voltage source side, one of terminals of said second resistor being connected to the emitter side of said second bipolar transistor, an other of the terminals of said second resistor being connected to a side of one of terminals of said third resistor, and an other of the terminals of said third resistor being connected to said constant voltage source.

6. A constant voltage output circuit having first and second bipolar transistors each having a base, an emitter, and a collector, wherein the bases of said first and second bipolar transistors are electrically connected, the emitter of said first bipolar transistor being connected to a reference line which is set to a predetermined electric potential through a first resistor which forms a first connection path, the emitter of said second bipolar transistor being connected to said reference line through second and third serially connected resistors to form a second connection path, independent of the first connection path, an operational amplifier being arranged so that an electric potential between the emitter of said first bipolar transistor and said first resistor and an electric potential between said second and third resistors regarding said second bipolar transistor are input, and an output terminal of said operational amplifier and the bases of said first and second bipolar transistors being connected.

7. A circuit according to claim 6, wherein the electric potential between said first bipolar transistor and said first resistor is an emitter electric potential of said first bipolar transistor.

8. A circuit according to claim 6, wherein the collectors of said first and second bipolar transistors are commonly connected to a power source line.

9. A circuit according to claim 6, wherein said predetermined potential is a ground potential.

10. A circuit according to claim 6, wherein an output from said operational amplifier is connected to the bases of said first and second bipolar transistors through a fourth resistor.

11. A circuit according to claim 10, further having a fifth resistor which is serially connected to said fourth resistor for said predetermined potential, and wherein an electric potential between said fourth and fifth resistors is set to a base potential of said first and second bipolar transistors.

12. A circuit according to claim 6, wherein said constant voltage output is taken out from a line between an output of the operational amplifier and the base of the bipolar transistor.

13. A constant voltage output circuit having first and second bipolar transistors each having a base, an emitter, and a collector, comprising:

the bases of said first and second bipolar transistors being electrically connected, a first connection path being provided through which the emitter of said first bipolar transistor is connected to a reference line which is set to a predetermined electric potential through a first resistor, a second connection path being provided, which is independent of said first connection path, through which the emitter of said second bipolar transistor is connected to said reference line through serially connected second and third resistors;

an operational amplifier being arranged so that an electric potential between the emitter of said first bipolar transistor and said first resistor and an electric potential between said second and third resistors regarding said second bipolar transistor being input to said operational amplifier, and an output terminal of said operational amplifier and the bases of said first and second bipolar transistors being connected.

* * * * *

UNITED STATES PATENT AND TRADEMARK OFFICE

CERTIFICATE OF CORRECTION

PATENT NO. : 6,020,731

DATED : February 1, 2000

INVENTOR(S) : MAHITO SHINOHARA

It is certified that error appears in the above-identified patent and that said Letters Patent is hereby corrected as shown below:

IN [56] REFERENCES CITED, UNDER U.S. PATENT DOCUMENTS, INSERT:

--4,945,260 7/90 Naghshineh et al. .... 307/296.6-
--5,488,329 1/96 Ridgers .... 327/539--.

IN [56] REFERENCES CITED, INSERT

--Foreign Patent Documents
0352044 1/90 European Patent Office
0656574 6/95 European Patent Office--.

IN ATTORNEY, AGENT OR FIRM
"Fitzpatrick Cella Harper & Scinto" should read
--Fitzpatrick, Cella, Harper & Scinto--

COLUMN 1

Line 53, "a" should be deleted

Line 54, "a" should be deleted

Line 56, "$1_0$." should read --$I_0$.--

UNITED STATES PATENT AND TRADEMARK OFFICE

CERTIFICATE OF CORRECTION

PATENT NO. : 6,020,731

DATED : February 1, 2000

INVENTOR(S) : MAHITO SHINOHARA

It is certified that error appears in the above-identified patent and that said Letters Patent is hereby corrected as shown below:

COLUMN 2

Line 19, "$(R_0/R_2)*(k/q)\cdot In_y$" should read --$(R_0/R_1)\cdot(k/q)\cdot In_y$-

COLUMN 5

Line 14, "30" should read --so--

COLUMN 6

Line 10, "an other" should read --another--

Line 13, "an other" should read --another--

Line 15, "an other" should read --another--

Line 32, "path" should read --path, and--

UNITED STATES PATENT AND TRADEMARK OFFICE

CERTIFICATE OF CORRECTION

PATENT NO. : 6,020,731

DATED : February 1, 2000

INVENTOR(S) : MAHITO SHINOHARA

It is certified that error appears in the above-identified patent and that said Letters Patent is hereby corrected as shown below:

COLUMN 7

Line 9, "resistors;" should read --resistors, and--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*